US011197358B2

(12) United States Patent
Nemati et al.

(10) Patent No.: US 11,197,358 B2
(45) Date of Patent: Dec. 7, 2021

(54) METHOD FOR REDUCING THE MAXIMUM DEMAND OF THE CURRENT RECEIVED BY AN LED MATRIX

(71) Applicant: HELLA GmbH & Co. KGaA, Lippstadt (DE)

(72) Inventors: Shaham Nemati, Dortmund (DE); Dieter Nietfeld, Paderborn (DE); Jacek Roslak, Paderborn (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/792,148

(22) Filed: Feb. 14, 2020

(65) Prior Publication Data

US 2020/0267816 A1 Aug. 20, 2020

(30) Foreign Application Priority Data

Feb. 14, 2019 (DE) ..... 10 2019 103 755.7

(51) Int. Cl.
*H05B 45/345* (2020.01)
*H05B 45/10* (2020.01)

(52) U.S. Cl.
CPC ..... *H05B 45/345* (2020.01); *H05B 45/10* (2020.01)

(58) Field of Classification Search
CPC ..... H05B 45/10; H05B 45/30; H05B 45/305; H05B 45/31; H05B 45/32; H05B 45/325; H05B 45/345; H05B 47/10; H05B 47/105; H05B 47/155; H05B 47/16
See application file for complete search history.

(56) References Cited

U.S. PATENT DOCUMENTS

| | | | | |
|---|---|---|---|---|
| 9,717,123 | B1 * | 7/2017 | Yao | H05B 45/10 |
| 2009/0134814 | A1 * | 5/2009 | Moon | H05B 45/44 315/294 |
| 2013/0162161 | A1 * | 6/2013 | Riess | H05B 47/10 315/210 |
| 2013/0241423 | A1 * | 9/2013 | Chu | H05B 45/44 315/191 |
| 2014/0217909 | A1 * | 8/2014 | Chu | H05B 45/44 315/192 |

(Continued)

FOREIGN PATENT DOCUMENTS

DE 102008060042 A1 9/2009

*Primary Examiner* — Jason Crawford
(74) *Attorney, Agent, or Firm* — Muncy, Geissler, Olds & Lowe, P.C.

(57) ABSTRACT

A method for reducing the maximum demand of the current received by an LED matrix from a current source. Each LED of the LED matrix receiving a pulse width-modulated current from the current source, an activation period being assigned to each LED in an elementary period of the pulse width-modulated current, and/or a deactivation period is assigned, in which no current flows through the LED, the activation period and the deactivation period being able to be equal in length or shorter than the elementary period, and in the case that the activation period assigned to one of the LEDs and the deactivation period assigned to this LED are shorter than an elementary period, the activation period begins at an activation point in time and ends at a deactivation point in time, and the deactivation period begins at the deactivation point in time and ends at the activation point in time.

16 Claims, 3 Drawing Sheets

(56) References Cited

U.S. PATENT DOCUMENTS

| | | | | |
|---|---|---|---|---|
| 2015/0022112 | A1* | 1/2015 | Nietfeld | H05B 45/46 315/210 |
| 2016/0358528 | A1* | 12/2016 | Xie | G09G 3/3413 |
| 2017/0111963 | A1* | 4/2017 | Kovatchev | B60Q 1/1415 |
| 2018/0182279 | A1* | 6/2018 | Sakariya | G09G 3/32 |
| 2018/0288839 | A1* | 10/2018 | Safaee | H02M 1/14 |
| 2019/0327809 | A1* | 10/2019 | Watsuda | H03K 7/08 |
| 2020/0128636 | A1* | 4/2020 | De Cicco | H05B 45/10 |

* cited by examiner

METHOD FOR REDUCING THE MAXIMUM DEMAND OF THE CURRENT RECEIVED BY AN LED MATRIX

This nonprovisional application claims priority under 35 U.S.C. § 119(a) to German Patent Application No. 10 2019 103 755.7, which was filed in Germany on Feb. 14, 2019, and which is herein incorporated by reference.

BACKGROUND OF THE INVENTION

Field of the Invention

The present invention relates to a method for reducing the maximum demand of the current received by an LED matrix from a current source, each LED of the LED matrix receiving a pulse width-modulated current from the current source, an activation period being assigned to each LED in an elementary period of the pulse width-modulated current, in which a current flows through the LED, and/or a deactivation period is assigned, in which no current flows through the LED, the activation period and the deactivation period being able to be equal in length or shorter than the elementary period, and in the case that the activation period assigned to one of the LEDs and the deactivation period assigned to this LED are shorter than an elementary period, the activation period begins at an activation point in time and ends at a deactivation point in time, and the deactivation period begins at the deactivation point in time and ends at the activation point in time.

Description of the Background Art

The pulse width modulation of current for controlling the brightness of LEDs is widely used. Setting the brightness of LEDs of an LED matrix with pulse width modulation is also widely used. This generally involves activating the LEDs at the beginning of an elementary period of the PWM clock cycle and deactivating them after the activation period selected for reaching the desired brightness. The activation thus takes place simultaneously for all LEDs; the deactivation may take place at a different deactivation point in time for each LED, depending on the selected activation period.

One disadvantage of this procedure is that the current source provided for supplying the LED matrix is subjected to a heavy load starting at the activation point in time. In practice, this has not up to now resulted in any limitations, due to the low current consumption of LEDs. Manufacturers of LED headlamps presently plan to use LED matrices with many trillions of LEDs. The current sources for such LED matrices must be designed to supply a current which is able to energize all LEDs in a matrix, at least for a short period of time, at the beginning of an elementary period. This may result in maximum current demands with steep edges for a short time. These, in turn, may bring about a large proportion of harmonics, which may be disadvantageous with regard to EMC, among other things.

SUMMARY OF THE INVENTION

It is therefore an object of the present invention to propose a method and a device with the aid of which the maximum demand of the current received by an LED matrix may be reduced.

In an exemplary embodiment, the object is achieved according to the invention in that the activation point in time of the activation period assigned to a first of the LEDs, whose activation period is shorter than the elementary period, is set to a point in time in the elementary period, and the activation points in time of the activation periods assigned to the other LEDs, whose activation period is shorter than the elementary period, are set to one of the deactivation points in time of an activation period of exactly one of the other LEDs.

Also, in an exemplary embodiment this object is achieved according to the invention in that the deactivation point in time of the activation period assigned to a first of the LEDs, whose activation period is shorter than the elementary period, is set to a point in time in the elementary period, and the deactivation points in time of the activation periods assigned to the other LEDs, whose activation period is shorter than the elementary period, are set to one of the activation points in time of an activation period of exactly one of the other LEDs.

Due to the method according to the invention, the activation periods of the LEDs which are not activated during the entire elementary period are arranged one after the other. It may be achieved thereby that not all LEDs are activated simultaneously at the beginning of the elementary period.

The activation point in time of the first of the LEDs can be set to the beginning of the elementary period. Correspondingly, in the second variant, the activation point in time of the first of the LEDs is set to the end of the elementary period.

If the sum of the activation points in time of the LEDs which are not activated during the entire elementary period exceeds the period of time between the activation point in time of the first LED and the end of the elementary period in the first variant of the invention, the activation period of at least one LED is divided: A first part of the activation period of this LED is set between the deactivation point in time of the previously activated LED and the end of the elementary period, and a second part begins at the beginning of the elementary period and ends at the deactivation point in time of this LED. Of course, the sum of the lengths of the two parts yields the activation period of this LED. As a result, the LED is activated for the predefined activation period during an elementary period, namely at the beginning of the elementary period during the second part of the activation period and at the end of the elementary period during the first part of the activation period.

Such a division of the activation period may take place multiple times if the sum of the activation times of the LEDs which are not to be activated during the entire elementary period is a multiple of one elementary period.

Correspondingly, the activation period of one or multiple LEDs may be divided if the time between the deactivation point in time of the first LED and the beginning of the elementary period is less than the sum of the activation periods of the LED which are not to be activated during the entire elementary period.

The method according to the invention may be carried out with the aid of a controller.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figures 1A, 1B, 1C, 1D, 2:
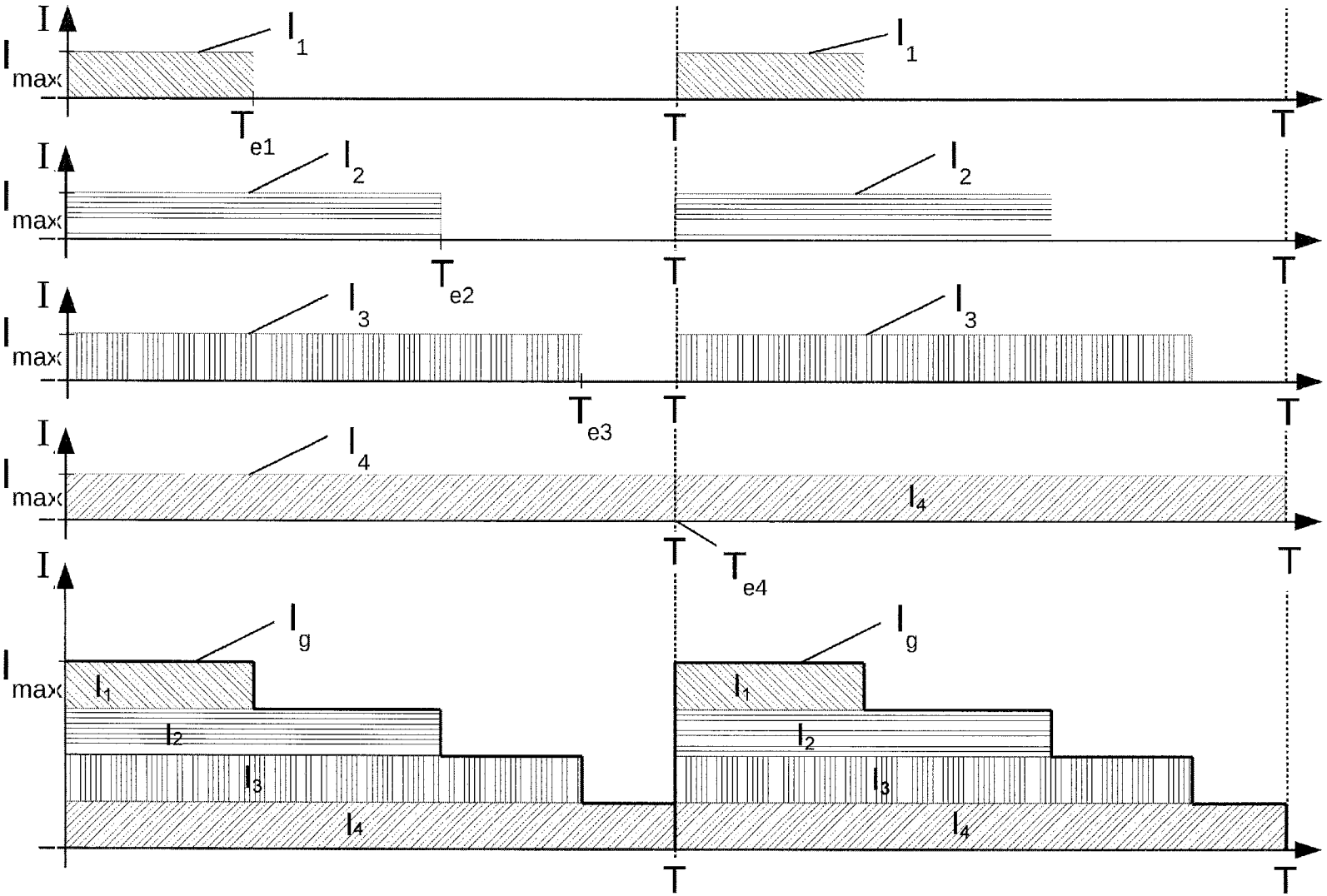
Fig. 2 (prior art)
FIGS. 1*a* to 1*d* schematically show the profiles of pulse width-modulated currents through four LEDs of an LED matrix.
FIG. 2 schematically shows the profile of the entire current consumption of the four LEDs in a method according to the prior art.
Figure 3:
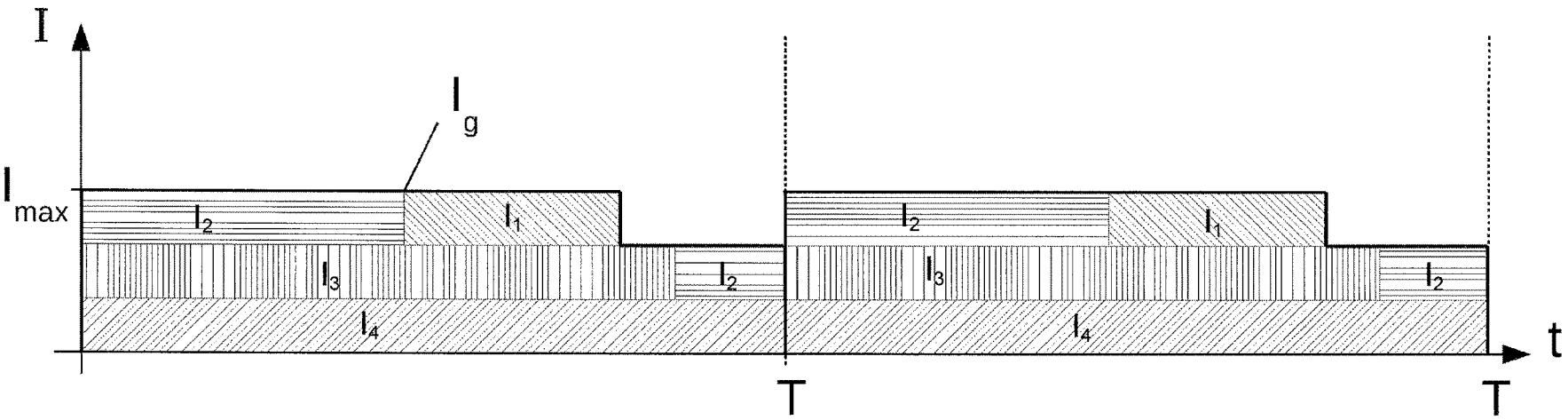
FIG. 3 schematically shows the profile of the entire current consumption of the four LEDs in a method according to the first variant of the invention.

FIGS. 1 through 3 show in greater detail based on the example of four LEDs of an LED matrix. The LED matrix may have more than these four LEDs. In particular, the LED matrix may have multiple thousand LEDs. However, the invention may be explained based on as few as four LEDs of an LED matrix of this type.

The LEDs are supplied with a pulse width-modulated current $I_1$, $I_2$, $I_3$, $I_4$, so that the LEDs light up with different brightnesses. Different brightnesses of the LEDs may be set with the aid of the current profiles of pulse width-modulated currents $I_1$, $I_2$, $I_3$, $I_4$ illustrated in partial FIGS. 1*a*, 1*b*, 1*c* and 1*d*. In each current profile, current pulses alternate during activation times $T_{e1}$, $T_{e2}$, $T_{e3}$, $T_{e4}$ and deactivation times. The current pulses cause the LEDs to briefly light up. Pulse width-modulated currents $I_1$, $I_2$, $I_3$, $I_4$ are pulsed in such a way that the pauses between the brief lighting up of the LEDs is not perceptible to the human eye. However, the longer the pause between the lighting up, the darker is an LED perceived to be.

Consequently, the LED supplied by pulse width-modulated current and illustrated in FIG. 1*a* is perceived by a human observer as being darker than the LED supplied by pulse width-modulated current $I_4$ illustrated in FIG. 1*d*. This also cause the areas illuminated by these LED to be perceived as being more poorly and less brightly illuminated.

The current profiles illustrated in FIGS. 1*b* and 1*c* result in brightnesses which lie between the brightnesses induced by current profiles $I_1$, $I_4$ according to FIGS. 1*a* and 1*d*.

If pulse width-modulated currents $I_1$, $I_2$, $I_3$, $I_4$ have a synchronous clock cycle for supplying the LEDs of an LED matrix, and if the current pulses begin at the start of a clock cycle, as is customary in pulse width modulation, in the current profiles from FIG. 1, this results in a total current $I_g$ of the four LEDs, as illustrated in FIG. 2. Total current $I_g$ results from adding up currents $I_1$, $I_2$, $I_3$, $I_4$ for supplying the individual LEDs.

The current profile of total current $I_g$ has multiple step changes during one clock cycle, at which the current drops, and a large step change at the beginning or end of a clock cycle, at which the current increases to a maximum demand.

Each step change has an effect on EMC. In addition, a current source supplying the LEDs is subjected to a heavy load at the beginning of each elementary period, due to the maximum demand of total current $I_g$.

Due to the method according to the invention, the number of step changes may be significantly reduced, and the maximum demand of total current $I_g$ may be significantly reduced.

A current profile of total current $I_g$ as shown in FIG. 3 results due to the method according to the invention in Variant 1. In this current profile, two step changes result, namely a downward step change and an upward step change by the same absolute value in each case. The maximum demand of total current $I_g$ is reduced, for example, by one quarter.

If one now considers an example comprising multiple thousands of LEDs of an LED matrix instead of the example with four LEDs of an LED matrix, it may be easy to imagine that the number of step changes as well as the step height and the maximum demand of total current $I_g$ may be even more significantly reduced, which results in an improvement of EMC and a lower load on the power supply system.

Figure 4:
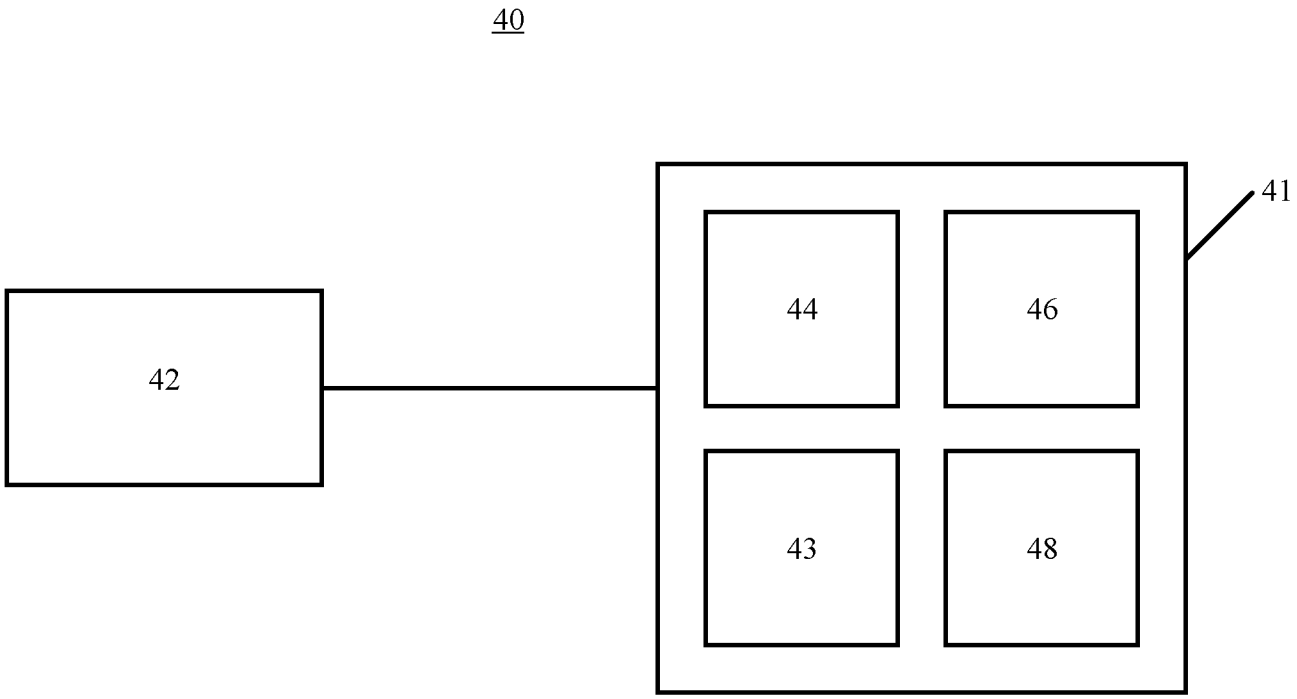
FIG. 4 schematically shows an LED matrix controlled according to a method of the invention.

The system 40 illustrated in FIG. 4 includes an LED matrix 41 with a controller 42 for controlling LEDs of the LED matrix 41. The LED matrix 41 includes a first LED 43, a second LED 44, a third LED 46, and a fourth LED 48.

The invention is implemented in that the LEDs which are not activated during an entire elementary period, whose activation period is thus shorter than the elementary period, are not activated simultaneously at the beginning of the elementary period. Instead, these LEDs are preferably activated one after the other. For this purpose, a first LED, in this case the LED having current profile $I_3$ according to FIG. 1*c*, is activated at the beginning of the elementary period. The activation point in time of this LED is thus set to the beginning of the elementary period. The activation point in time of the next LED is then set to a deactivation point in time of this first LED at the end of the activation period.

Since the period of time between the activation point in time of this second LED and the end of the elementary period is less than the activation period of the second LED, the activation period is divided into two parts: A first part begins at the activation point in time of the second LED and ends at the end of the elementary period. A second part begins at the beginning of the elementary period and ends at the deactivation point in time at the end of the deactivation period of the second elementary period. Together, the two parts yield the activation period of the second LED.

Due to the fact that the first part is at the end of an elementary period and the second part at the beginning of an elementary period, this incidentally does not result in the second LED being activated or deactivated more often than in the conventional method. The first part at the end of an elementary period and the second part at the beginning of an elementary period following directly thereafter merge with each other, so that the second LED does not have to be deactivated at the end of an elementary period and does not have to be activated at the beginning of an elementary period.

The activation period of the third LED (FIG. 1*a*) then occurs directly after the activation period of the second LED. Since the period of time between the deactivation point in time of the second LED and the end of the elementary period is greater than the activation period of the third LED, it is not necessary to divide the activation period of the third LED.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for reducing a maximum demand of a current received by an LED matrix from a current source, the method comprising:

receiving, by at least one LED of the LED matrix, a pulse width-modulated current from the current source;

assigning an activation period to a first LED of the at least one LED in an elementary period of the pulse width-modulated current in which a current flows through the first LED, and assigning a deactivation period in which no current flows through the first LED, the activation period and the deactivation period being equal in length or shorter than the elementary period;

setting to a point in time in the elementary period a first activation point in time of the activation period assigned to the first LED, the first LED having a first activation period that is shorter than the elementary period;

setting, a second activation point in time of a second activation period within the elementary period assigned to a second LED of the LED matrix to a first deactivation point in time of the first activation period of the first LED;

setting, a third activation point in time of a third activation period within the elementary period assigned to a third LED of the LED matrix to a second deactivation point in time of the second activation period of the second LED or to a beginning of the elementary period;

setting, a fourth activation point in time of a fourth activation period within the elementary period assigned to a fourth LED of the LED matrix to a third deactivation point in time of the third activation period of the third LED or to the beginning of the elementary period, wherein the activation point in time of the first LED is set to the beginning of the elementary period, wherein the third activation point in time or the fourth activation point in time is set to the beginning of the elementary period, and wherein the third activation period or the fourth activation period overlap in time with the first activation period.

2. The method according to claim 1, wherein the fourth activation point in time of the fourth LED is set to a deactivation point in time of the third activation period.

3. The method according to claim 1, wherein, when setting the second activation point in time of the second activation period of the second LED whose activation period is shorter than the elementary period, the second activation period of the second LED within the elementary period is divided as soon as a period of time between the second activation point in time and an end of the elementary period is less than the second activation period.

4. The method according to claim 1, wherein the second activation period of the second LED is divided such that a first part of the second activation period extends from the second activation point in time to the end of the elementary period, and a second part of the second activation period extends from the beginning of a following elementary period to the second deactivation point in time of the second activation period.

5. The method according to claim 1, wherein, when setting the deactivation point in time of the second activation period of the second LED, the second activation period within the elementary period is divided as soon as a period of time between the first deactivation point in time and a beginning of a subsequent elementary period is less than the second activation period.

6. The method according to claim 1, wherein the second activation period of the second LED is divided such that a first part of the second activation period extends from the second deactivation point in time to the beginning of the elementary period, and a second part extends from an end of the elementary period to the first deactivation point in time of the first LED.

7. A device configured to carry out the method according to claim 1.

8. The method according to claim 1, wherein if the second activation period is greater than a remaining period between the first deactivation point in time and an end of the elementary period, the second activation period is divided into a first portion and a second portion, wherein the first portion of the second activation period ends at the end of the elementary period, and wherein the second portion of the second activation period overlaps in time with the first activation period and the fourth activation period.

9. The method according to claim 1, wherein if the second activation period is greater than a remaining period between the first deactivation point in time and an end of the elementary period, the second activation period is divided into a first portion and a second portion, wherein the first portion of the second activation period ends at the end of the elementary period, and wherein the second portion of the second activation period begins at the beginning of the elementary period.

10. A method for reducing a maximum demand of current received by an LED matrix from a current source, the method comprising:

receiving by each LED of the LED matrix, a pulse width-modulated current from the current source; and assigning an activation period to each LED in an elementary period of the pulse width-modulated current, in which a current flows through each LED of the LED matrix, and assigning a deactivation period, in which no current flows through each LED of the LED matrix, the activation period and the deactivation period being equal in length or shorter than the elementary period;

wherein a deactivation point in time of a first activation period is assigned to a first LED of the LED matrix, the first activation period of the first LED being shorter than the elementary period, is set to a point in time in the elementary period, and wherein a deactivation point in time of a second activation period assigned to a second LED of the LED matrix, whose activation period is shorter than the elementary period, is set to the activation point in time of the first activation period of the first LED, wherein a deactivation point in time of a third activation period within the elementary period assigned to a third LED of the LED matrix is set to an activation point in time of the second activation period of the second LED or to an end of the elementary period;

wherein a deactivation point in time of a fourth activation period within the elementary period assigned to a fourth LED of the LED matrix is set to an activation point in time of the third activation period of the third LED or to an end of the elementary period, wherein the deactivation point in time of the third activation period or the deactivation point in time of the fourth activation period is set to the end of the elementary period, wherein the deactivation point in time of the first LED is set to the end of the elementary period, and wherein the third activation period or the fourth activation period overlap in time with the first activation period.

11. The method according to claim 10, wherein the deactivation point in time of the third LED is set to the end of the elementary period.

12. A method for controlling a first activation period of a first LED and a second activation period of a second LED of an LED matrix, the LED matrix being activated for an elementary period, the first and activation periods being periods during which current flows through the first and second LEDs, the method comprising:

setting a first activation point as a beginning of the first activation period within the elementary period, wherein the first activation period is shorter than the elementary period, the first activation period terminating at a first deactivation point;

assigning the first activation period in the elementary period;

setting a second activation point within the elementary period as a beginning of the second activation period, wherein the second activation period is shorter than the elementary period, the second activation period terminating at a second deactivation point; and assigning the second activation period in the elementary period, wherein the first activation point is set at a beginning of the elementary period and the second activation point is set at the first deactivation point, thereby reducing a total number of overlapping activation periods within the elementary period.

13. The method according to claim 12, wherein if the second activation period is greater than a remaining period between the first deactivation point and an end of the elementary period, the second activation period is divided, wherein a first portion of the second activation period extends from the first deactivation point to the end of the elementary period and a second portion of the second activation period extends from the beginning of the elementary period to the second deactivation point at a completion of the second activation period.

14. The method according to claim 12, wherein if the second activation period is greater than a remaining period between the first deactivation point and an end of the elementary period, the second activation period is divided into a first portion and a second portion, wherein the first portion of the second activation period ends at the end of the elementary period, and wherein the second portion of the second activation period overlaps in time with the first activation period and the fourth activation period.

15. The method according to claim 12, wherein if the second activation period is greater than a remaining period between the first deactivation point and an end of the elementary period, the second activation period is divided into a first portion and a second portion, wherein the first portion of the second activation period ends at the end of the elementary period, and wherein the second portion of the second activation period begins at the beginning of the elementary period.

16. The method according to claim 12, wherein, when setting the second deactivation point of the second activation period of the second LED, the second activation period within the elementary period is divided as soon as a period of time between the first deactivation point in time and a beginning of a subsequent elementary period is less than the second activation period.

* * * * *